United States Patent [19]

Stoppazzini

[11] Patent Number: 5,060,488

[45] Date of Patent: Oct. 29, 1991

[54] DEVICE FOR SUPPORTING AND CONTROLLING STITCH-PRESSING AND STITCH-RETAINING MEANS IN AN AUTOMATIC STRAIGHT KNITTING MACHINE

[75] Inventor: Benito Stoppazzini, Sala Bolognese, Italy

[73] Assignee: E.M.M. S.r.l., Padulle Di Sala Bolognese, Italy

[21] Appl. No.: 526,826

[22] Filed: May 22, 1990

[30] Foreign Application Priority Data

May 29, 1989 [IT] Italy ..... 3496 A/89

[51] Int. Cl.[5] ..... D04B 7/04; D04B 35/00

[52] U.S. Cl. ..... 66/64; 66/90

[58] Field of Search ..... 66/60 R, 64, 90

[56] References Cited

U.S. PATENT DOCUMENTS

| | | | |
|---|---|---|---|
| 4,442,683 | 4/1984 | Shima et al. | 66/64 |
| 4,852,369 | 8/1989 | Stoppazzini | 66/64 |

FOREIGN PATENT DOCUMENTS

| | | | |
|---|---|---|---|
| 217754 | 4/1987 | European Pat. Off. . | |
| 310565 | 4/1989 | European Pat. Off. . | |
| 3321227 | 12/1984 | Fed. Rep. of Germany | 66/64 |
| 710396 | 1/1988 | Fed. Rep. of Germany | 66/64 |
| 61-19844 | 1/1986 | Japan | 66/64 |

*Primary Examiner*—Wm. Carter Reynolds

*Attorney, Agent, or Firm*—Darby & Darby

[57] ABSTRACT

The device comprises a plate placed over the needle beds and provided with two vertical grooves for each work zone. Within the grooves small bars slide vertically because of the action of a rocking lever that acts on the bars through two arms. The rocking lever has a third arm subject to the action of a rack, while a segment is hinged to each small bar and bears, fixed to its lower end, a small rod having a "L" shape, for pressing over the fabric. The rod extends for the whole length of the associated work zone. The grooves determine the contemporary oscillation of the small bars in opposite directions during their vertical movement, to allow the concurrent change of position of the small rods, while a wedge-shaped element, for retaining the fabric, is placed at the beginning and at the end of each work zone.

6 Claims, 3 Drawing Sheets

DEVICE FOR SUPPORTING AND CONTROLLING STITCH-PRESSING AND STITCH-RETAINING MEANS IN AN AUTOMATIC STRAIGHT KNITTING MACHINE

BACKGROUND OF THE INVENTION

The invention relates to a device that has the task of supporting and controlling stitch-pressing and stitch-retaining means provided in an automatic straight knitting machine.

DESCRIPTION OF THE PRIOR ART

It is known that the needle beds of an automatic straight knitting machine, over which a carriage is sliding according to a reciprocating motion, are provided with slits equally spaced and perpendicular to the direction of translation of the carriage.

The function of the carriage is to send into operation, in consecutive times, the needles placed inside the slits, in the way described here below.

Sending the needles into operation means basically that they are raised, i.e. they are made to slide inside the relative slit until they come out for a determined length over the needle beds, and they are subsequently lowered so to form stitches which compose the row being knitted.

The sending into operation is achieved through the cooperation of means, such as plates which can be inserted into the same slits, and a series of cams placed in the inner walls of the carriage.

The needles are raised consecutively to define groups of a few units, in correspondence with one or more so-called work zones, dynamically placed beneath the carriage.

As a matter of fact, in the technologically most advanced machines, several groups of cams are provided, also called operating units, therefore several work zones are defined along the needle beds, with the consequent contemporary formation of several knitted rows.

The optimal yield in fabric knitting, following the operations described above, would be achieved in the case that the last row knitted were not dragged upwards owing to the needles being raised. It would also turn out to be necessary to press downwards a short length of the last row of knitted fabric, placed immediately downstream from each work zone, i.e. immediately downstream from the zone affected by the needles in phase of return to their so-called rest position.

In the German patent application published with No. OS 3336781 (TEXTIMA) a device is described, which comprises a bent rod, integral with the carriage, positioned in correspondence with the longitudinal heads of the needle beds and oriented parallel to the latter, so to find itself in the zone dynamically affected by the raising of needles, and practically in contact with the last row of knitted fabric, pressing the same downwards.

The rod finding itself below the portions of needles coming out of the needle beds prevents the fabric from raising when the needles are raised.

Such a rod is known by those skilled in the field, as well as other means having similar operating features and structure, under the name "stitch-pressing means".

In the same Patent Application No. OS 3336781 the device described comprises also a disk, supported by the carriage, placed immediately downstream from the needle work zone and oriented parallel to the direction of translation of the carriage, so to press downwards a portion of the last row just knitted.

The disk mentioned above, as well as other devices with similar operating features and structure, are usually referred to by those skilled in the field as "stitch-retaining means".

The U.S. Pat. No. 4,463,577, on the other hand, provides for a device for supporting the stitch-pressing means that results to be integral with a slide sliding over the needle beds along one of the thread guides.

The slide may be dragged along the guide by the carriage through special means, e.g. suitable pins, provided on the same and made properly operating.

The U.S. Pat. No. 4,442,683 provides for stitch-pressing means disposed in pairs on the carriage and which may be actuated in phase relationship with the translational motion of the carriage. The stitch-pressing means of each pair are designed to work respectively in both senses of translation of the carriage, and they have to be correspondingly actuated, according to the sense of translation of the latter.

For this purpose, and to make it possible for them to affect the whole work zone of the needles related to themselves, the sets of stitch-pressing means are disposed in pairs and inclined on the carriage, bilaterally as to the needle beds, and are alternately caused to press the fabric being knitted.

Stitch-retaining means are interposed between the stitch-pressing means of each set, and are subjected to the action of springs which press them onto the last row of fabric being knitted, upstream and downstream from each work zone of the needles.

The U.S. Pat. No. 4,501,132 provides for a device for supporting stitch-pressing means, which basically comprises a small vertical bar oscillating parallel to the plane of symmetry of the needle beds, and to whose base two small inclined rods are fastened. The oscillation of the small bar in either direction is determined according to the sense of translation of the carriage, in such a way that either small rod finds itself in horizontal position, so pressing the rows being knitted in the needles work zone.

In the U.S. Pat. No. 4,516,411, a device is described, in which the stitch-pressing means, disposed in series and supported by the carriage of the machine on which they are operating, are actuated through cam grooves provided on the needle beds and acting on suitable pins associated with the stitch-pressing means supporting device.

The Swiss Pat. No. 382361 describes a device which supports a pair of stitch-pressing means disposed in series and which may be alternately actuated according to the sense of translation of the carriage. The stitch-pressing means, in this case, are hinged to the device, in such a way that they may be made operative or inoperative by their rotation.

Stitch-retaining means, consisting of pairs of disks arranged in series, are also supported by the device, and operate both upstream and downstream from the work zone of the needles.

In the European Patent Application No. 86830241.5 filed in the name of the same Applicant, a device is described, comprising rods placed beneath the needle beds oriented perpendicularly as to the direction of translation of the carriage, which may be raised or lowered by corresponding cams provided on the carriage, in such a way as to be inserted with their ends between the last knitted rows of the fabric, in the zone corresponding to the zone where the needles are raised, so keeping the fabric down.

The device described in the latter Application comprises also some plates placed upstream and downstream from the work zones of needles.

Such plates have the purpose of pressing the fabric down (stitch-retaining) both before and after the work zone.

The same Applicant, moreover, with the Patent Application No. 4961B/87 filed in Italy on Oct. 2, 1987, corresponding to the European Patent Application No. 88830288.2, filed on July 7, 1988 and to the Patent Application No. 215.650 filed in the U.S.A. on July 6, 1988, now U.S. Pat. No. 4,852,369 discloses a device for supporting, controlling and checking stitch-pressing and stitch-retaining means in an automatic straight knitting machine.

Said device comprises a box-type element fastened to the machine carriage, a vertical plate integral with the box element and positioned over the needle beds, a series of small bars placed in as many vertical grooves made on the plate, a rocking lever for each pair of small bars, acting with two arms on the relative small bars, and with a third arm engaged with a rack on which the pinion gear of a stepping motor is acting.

Finally, the stitch-pressing (or stitch-retaining) means are fastened to the lower ends of the small bar.

The rotation of the stepping motor in either direction determines the rotation in the same sense of the rocking levers, with the consequent rising and lowering of the small bars respectively odd and even.

Thus, actuating the motor in either sense, it is possible to control the actuation of the stitch-pressing (or stitch-retaining) means, corresponding to either direction of translation of the carriage.

SUMMARY OF THE INVENTION

The object of this invention is to supply a device which is suited to support and control the actuation of stitch-pressing means acting on the fabric being knitted for the whole length of the needles work zone.

A further object of this invention is to present a device which is suited to make the stitch-pressing and stitch-retaining means operative with respect to both senses of translation of the carriage, without bringing about a limitation in terms of functionality and productivity of the machine.

Furthermore, the device being the subject of this application requires to be realized through a technical solution which is simple and inexpensive to carry out.

Said objects are achieved through a device for supporting and controlling stitch-pressing and stitch-retaining means, these latter being designed to press on corresponding portions of the knitted fabric being formed on an automatic straight knitting machine, said portions being dynamically located in proximity of at least one work zone of the needles of said machine, with the latter comprising at least one needle bed over which a carriage is sliding, according to a reciprocating motion, to send said needles into operation, these latter being housed in said needle bed, and with said device comprising: a plate held vertically by support means over said needle bed and provided, on at least one of its sides, with at least two vertical grooves, for each said work zone, disposed bilaterally with respect to the latter, within which an equal number of small bars is placed, with the possibility for them to slide vertically and axially according to opposite directions respectively rising and lowering; a rocking lever for each pair of small bars, hinged to said plate and provided with two arms acting with their free ends respectively on said small bars, as well as with a third arm subjected to the action of drive means suited to bring about the corresponding swinging of said rocking levers in opposite directions lying in planes parallel to said plate, respectively to achieve the translation of said even small bars according to said raising sense with the contemporary translation of said odd small bars according to said lowering sense and vice versa; a segment for each small bar hinged to the latter with one end and disposed vertically so to be able to swing according to opposite directions perpendicular to said plate; stitch-pressing means fastened to the lower end of said small bars and extending for the whole length of the relative work zone of needles; drive means for said segments suited to cause them to swing simultaneously according to said opposite directions perpendicular to said plate, during their vertical sliding, to allow the mutual change of position of said stitch-pressing means; a series of stitch-retaining means being placed and operating at the beginning and at the end of each work zone.

BRIEF DESCRIPTION OF THE DRAWINGS

The details of the invention, not emerging from what has been said above, are pointed out below, with particular reference to the drawings attached herewith, where.

DESCRIPTION OF THE PREFERRED EMBODIMENT

With reference to the above-mentioned figures, numbers 15 and 16 are meant to indicate the needle beds of an automatic straight knitting machine, supported, in a known way, by a frame not illustrated.

The needle beds 15 and 16, as it is known, are provided with equally spaced slits (not displayed in the figure) inside which the needles 17 are placed.

Over the needle beds a carriage 5 is sliding, illustrated schematically since it is known, movable parallel to the same needle beds, with a to-and-fro motion.

An electronic control unit is provided (not illustrated since it is known), having the purpose to control the switching on and off of the operating units provided on the carriage to send the needles into operation, according to the directions contained in a knitting programme.

The needles 17 are consecutively sent into operation, in correspondence with one or more zones Z, dynamically located beneath the carriage 5.

Figure 2:
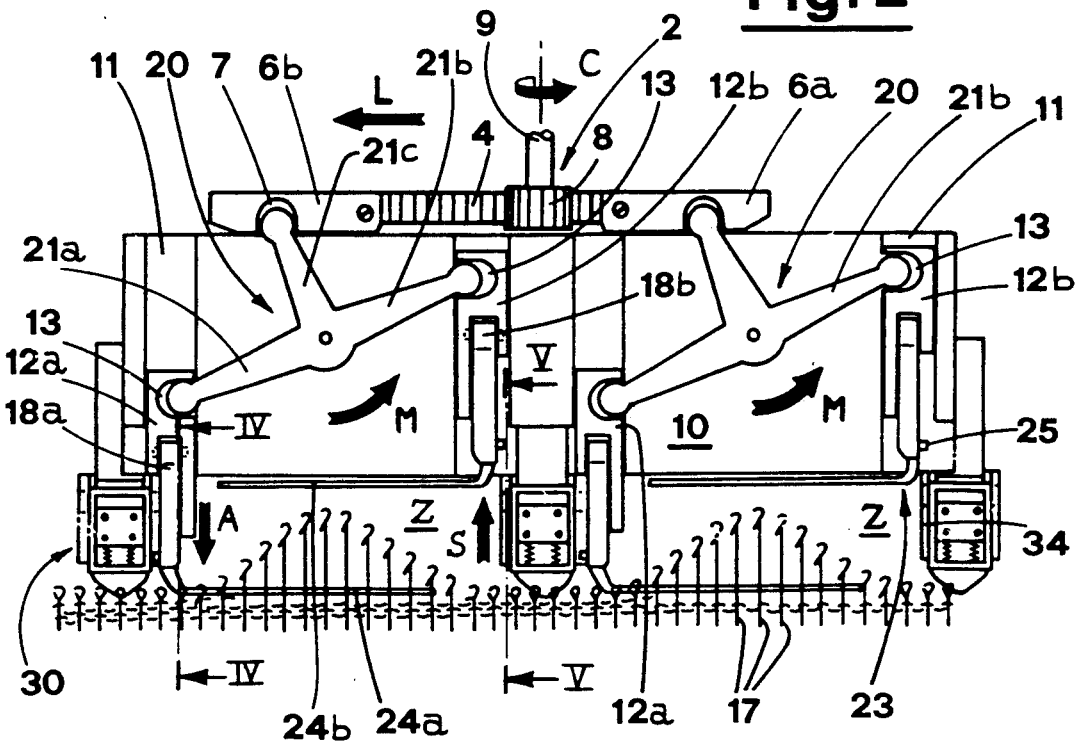
FIGS. 2 and 3 show a schematic view of the device in two operating positions respectively relating to the two senses of translation of the carriage.
Figure 3:
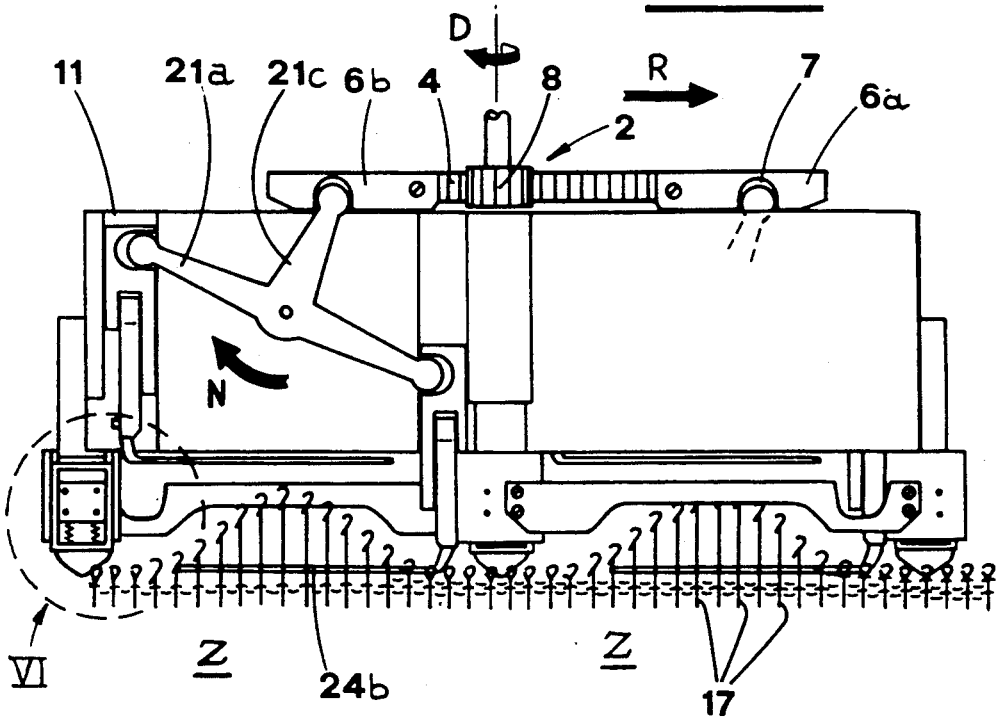

In the example illustrated in the FIGS. 2 and 3, two work zones Z are provided for the needles 17, which are sent into operation by an equal number of operating units associated with the carriage 5.

A box-type element 1 is fastened to the upper part of the carriage 5, e.g. by means of two support studs 3.

A plate 10 is made integral to the element 1 and it is disposed vertically over the needle beds 15 and 16, in a symmetric position with respect to them.

The plate 10 is provided, in one of its sides, with a series of grooves 11, disposed in pairs, the grooves of each pair being located bilaterally as to the operating units, thus with respect to the relative work zones Z.

The purpose of the grooves 11 of each pair related to each zone Z, is to receive and guide an equal number of small bars 12*a* and 12*b*, even and odd respectively, in such a way that these latter may slide axially, in vertical sense, according to opposite directions A and S, raising and lowering respectively.

The small bars 12*a* and 12*b* of each pair, relative to each zone Z, are in mutual dynamic relationship, as described below.

For each pair of small bars a rocking lever 20 is provided, hinged to the plate 10 in central position as to the same small bars, so to be able to swing around an axis perpendicular to the plate 10, according to opposite senses M and N.

Two arms 21*a* and 21*b* of the rocking lever 20 are fitting with their free ends into corresponding seats 13 respectively made on the small bars 12*a* and 12*b*. A third arm 21*c*, extending upwards from each rocking lever, engages with drive means 2.

In the example illustrated in the drawings attached herewith, being two the zones Z provided, thus being two the pairs of small bars 12*a* and 12*b*, there are two rocking levers 20, from which two arms 21*c* are branching off.

The drive means 2 are comprising a rack rod 4, placed over the plate 10 parallel to the same with the possibility to translate axially according to opposite directions L and R, engaging with a pinion gear 8 splined to the shaft 9 of a stepping motor 14, placed inside the element 1.

To both ends of the rack 4, two end pieces 6*a* and 6*b* are fastened, provided with recesses 7 suited to receive the free ends of said arms 21*c*.

The rotation of the shaft 9 and of the pinion gear 8, brought about by the motor 14 according to the sense C, causes the translation of the rack rod respectively in the sense L, with the rocking levers 20 swinging in the sense M to lower, in the sense A, the even small bars 12*a*, while raising the odd small bars 12*b* according to the sense S.

On the contrary, the rotation of the motor 14 according to the sense D brings about the translation of the rack rod in the sense R, with the consequent rotation of the rocking levers 20 in the sense N and the translation of the small bars 12*a* and 12*b* in opposite directions as to the previous ones.

The actuation of the motor 14, with the rack 4 translating in either direction, is brought about every time that the sense of translation of the carriage is reversed.

The small bars 12*a* and 12*b* hold, hinged to themselves with one of their ends, as many segments 18*a* and 18*b*, which remain turned downwards and may swing according to the senses T and U lying in vertical planes and being perpendicular to the plate 10.

With the free ends of the segments 18*a* and 18*b* the stitch-pressing means 23 are made integral, which are consisting of as many small rods 24*a* and 24*b* having a suitable "L" shape.

The small rods 24*a* and 24*b* related to each pair of small bars 12*a* and 12*b* extend horizontally, each of them towards the small bar related to the remaining small rod, and for the whole length of the work zone Z.

The segments 18*a* and 18*b* are also provided, on the opposite side as to the relative work zone Z, of a pin 25 suited to fit and slide, when the small bars are in the lower part of their travel, along guide means consisting of suitable corresponding cam grooves 26*a*, relative to the even small bars 12*a*, and 26*b*, relative to the odd small bars 12*b*. Construction of the cam grooves is described in greater detail hereinafter.

The cam grooves 26*a* and 26*b*, vertical and bilateral as to each pair of small bars, have the purpose to bring about and to guide the swinging of the segments 18*a* and 18*b* respectively according to the senses T and U (see FIGS. 4*b* and 5*b*), in order to allow the contemporary passage of the small rod being lowered and of that being raised, which change their mutual position.

Figure 4A:
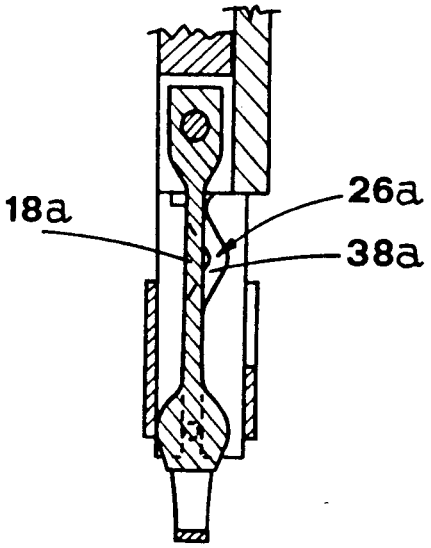
FIGS. 4*a* and 4*b* illustrate the device seen according to the section line IV—IV of FIG. 2, respectively in the two operating positions corresponding to the two senses of translation of the carriage.
Figure 5A:
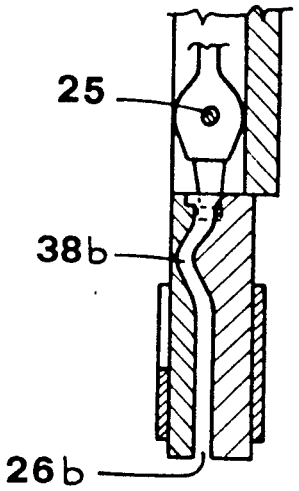
FIGS. 5*a* and 5*b* illustrate the device seen according to the section line V—V of FIG. 2, respectively in the two operating positions corresponding to the two senses of translation of the carriage.

For such a purpose, the grooves 26*a* and 26*b* relative to each pair of small bars are provided with loops 38*a* and 38*b*, each of them turned to the opposite side as to the other, as it may well be seen in FIGS. 4*a* and 5*a*.

Figure 4B:
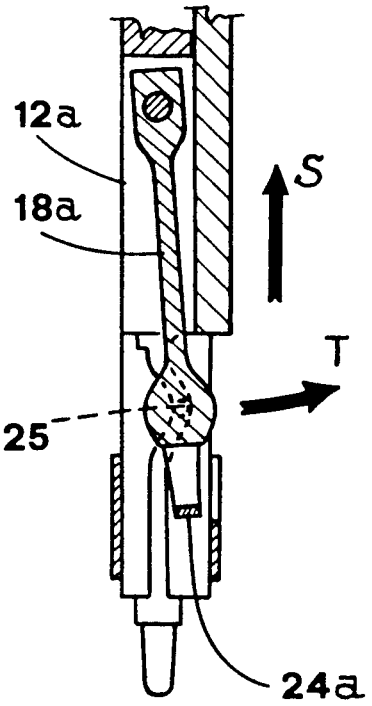

In the FIGS. 4*a* and 4*b* two subsequent positions are shown, taken by a segment 18*a* during the raising motion S of the relative small bar 12*a*.

Figure 5B:
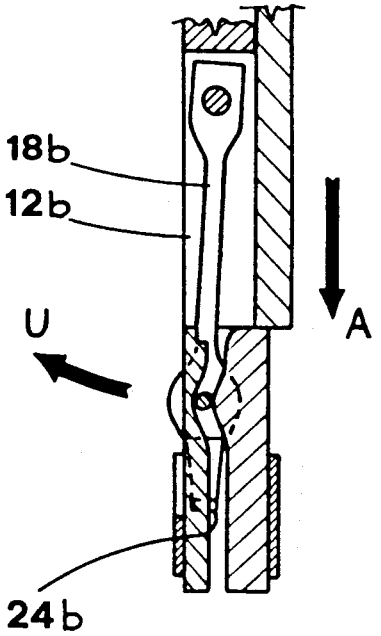

Correspondingly, in the FIGS. 5*a* and 5*b* two subsequent positions are shown, taken by a segment 18*b*, opposed to the segment 18*a*, during the lowering motion A of the relative small bar 12*b*.

As it is clearly visible in FIGS. 4*b* and 5*b*, the movements in opposite directions T and U of the segments 18*a* and 18*b*, which take place when the pins 25 of these latter are passing in proximity of the loops 38*a* and 38*b*, allow the passage at the same height of the two relative small rods 24*a* and 24*b*, which would interfere with each other if the paths of segments were completely straight.

The device being the subject of this invention comprises also a series of stitch-retaining means 30, located upstream and downstream from each work zone Z, whose number exceeds by one unit the number of operating units provided in the carriage; in the example illustrated here, since two work zones Z are provided, three stitch-retaining means 30 are associated with the device, two of them being placed at the ends of the plate 10 and one being interposed between the two pairs of grooves.

Figure 1:
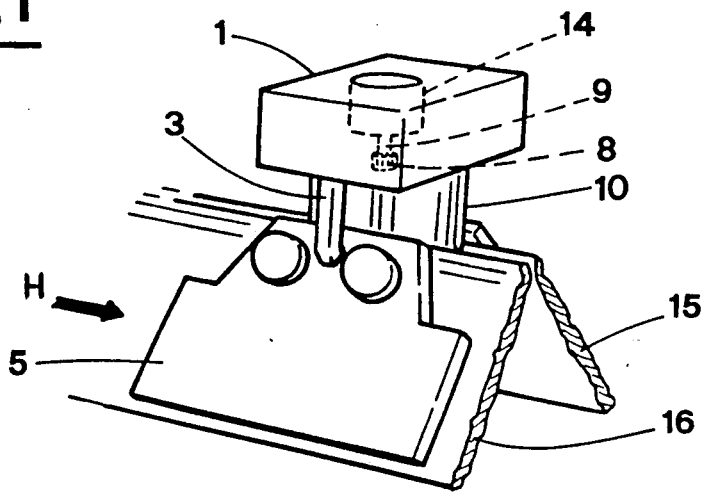
FIG. 1 shows, in a schematic perspective view, the device being the subject of this invention, associated with the carriage of a straight knitting machine.
Figure 6:
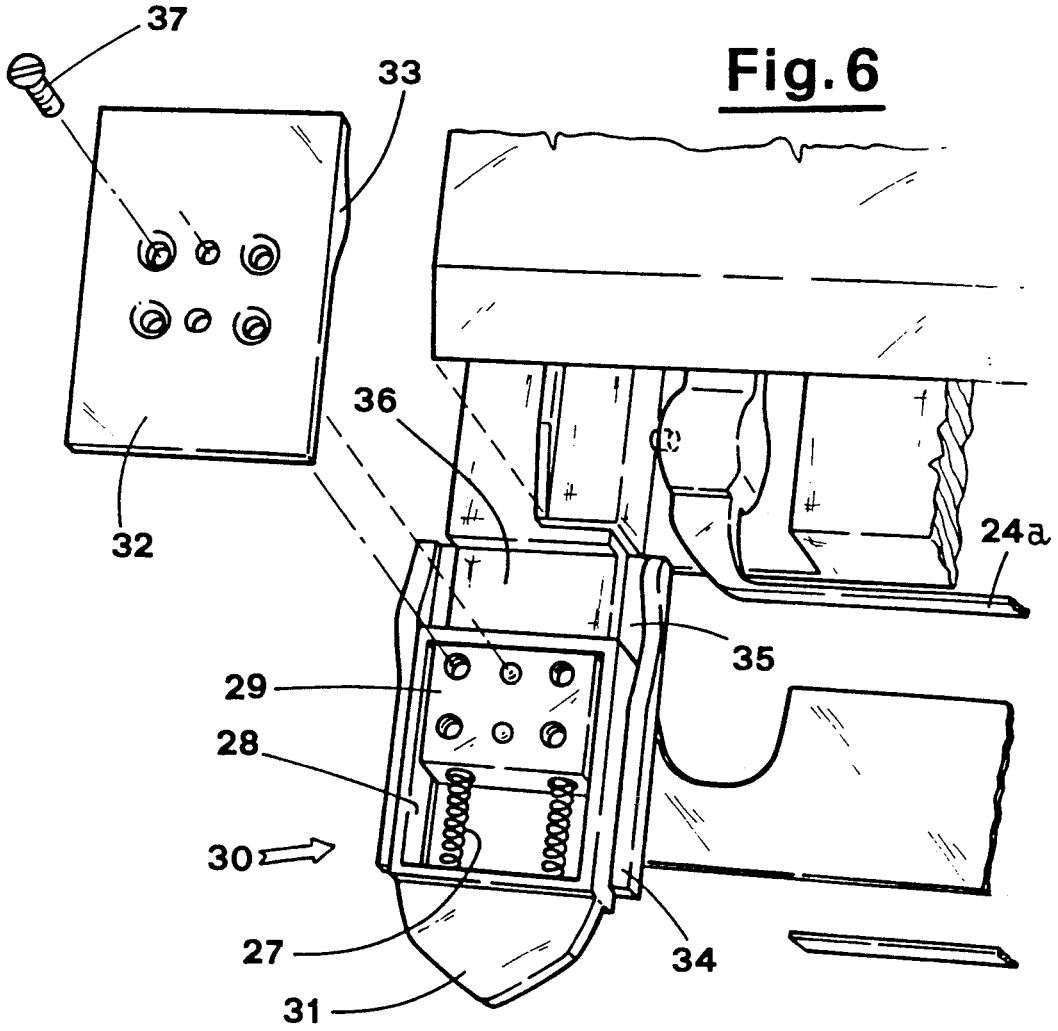
FIG. 6 illustrates, drawn to an enlarged scale, the detail VI of FIG. 3, in a perspective view.

As it is illustrated in FIG. 6, each stitch-retaining means 30 comprises a parallelepipedal block 29 fastened in a known way, e.g. by means of screws, to an extension 36 of the plate 10, extending downwards.

Around the block 29, a framework 28 is arranged, whose inner hole has such a size as to allow it to slide vertically, in said senses A and S, but not horizontally, with respect to the block 29.

Elastic means, consisting of a pair of springs 27, are interposed between the lower surface of the block 29 and the corresponding upper surface of the base of the framework 28, in such a way that their elastic reaction keeps the framework constantly lowered with a certain predetermined pressure.

With the lower face of the base of the framework 28 a wedge-shaped element 31 is made integral, with its tip turned downwards, oriented parallel as well as symmetrical to the needle beds.

The wedge-shaped element 31, which is the part of the stitch-retaining means which presses on the knitted fabric just formed, may be fastened to the framework by known means, or made in a single body with it.

A first small plate 32 is fastened, e.g. by means of screws 37, over the block 29, so preventing the framework 28 from coming out of its seat.

The vertical edges 33 of the small plate are shaped in such a way as to form said grooves 26*a* and 26*b*, in cooperation with complementary bulges 34 provided on the vertical edges of a second small plate 35, equally fastened to the side of the extension 36 opposed to the block 29.

The advantages arising from the adoption of the device made in accordance with this invention are self-evident.

The stepping motor 14 makes it possible to regulate the pressure on the small bars, thus on the fabric, with accuracy, furthermore the stitch-pressing means operate on the whole length of the work zone Z, though with the possibility of interchanging such means easily and quickly following the change of sense of translation of the carriage.

A very important advantage is the possibility of electronic control of the raising and lowering of the small bars 12*a* and 12*b*, to actuate the stitch-pressing means in proximity of the zones Z, through pulses sent to the motor 14 by the electronic control unit according to corresponding directions suitably included in the knitting program. Still through directions included in the program, it is possible to check the pressure of the stitch-pressing means on the fabric by virtue of the possibility to control the rotation of the stepping motor.

Immediately downstream from each zone Z the corresponding stitch-retaining means 30 is operating, which presses downwards the row of fabric just knitted.

The springs 27, on one hand, act on the wedge-shaped element 31 so to cause it to exert a predetermined pressing action on the fabric, on the other hand they allow the framework 28, thus the element 31, to be raised in the presence of anomalous hindrances.

Indeed, the wedge shape of the element 31 has been specially designed to avoid causing interference both with the needles placed downstream, in the raising phase, and with the needles placed upstream, in the lowering phase.

Finally, the device described here turns out to be simple and inexpensive to carry out, with obviously favourable effects on the total cost of the knitting machine.

It is understood that the above has been described by way of example and not as a limitation, therefore any possible variation of constructional details is to be considered as covered by the patent hereby applied for, as described above and according to the following claims.

What is claimed is:

1. A device for supporting and controlling stitch-pressing and stitch-retaining means designed to press on corresponding portions of the knitted fabric being formed on an automatic straight knitting machine, said portions being dynamically located in proximity of at least one work zone of needles of said machine, with said machine comprising at least one needle bed bearing a plurality of needles, and a carriage made to reciprocate over said needle bed in order to send said needles into operation, said device comprising:

a plate held vertically by support means over said needle bed and featuring, on at least one side, at least two vertical grooves disposed bilaterally with respect to each of said work zone;

small bars, namely even small bars and odd small bars, placed into said grooves, with possibility for said bars to slide vertically and axially according to opposite directions, respectively rising direction and lowering direction;

a rocking lever for each pair of small bars hinged to said plate and provided with two arms acting with two free ends respectively on said small bars, and provided with a third arm subjected to the action of drive means suited to bring about the swinging in the same sense of said rocking levers in opposite directions lying in planes parallel to said plate, respectively to achieve the translation of said even small bars according to said raising direction, with the contemporary translation of said odd small bars according to said lowering direction, and vice versa;

a segment for each of said small bars, said segment being hinged to said bar with one end and disposed vertically so as to be able to swing according to opposite directions perpendicular to said plate;

stitch-pressing means fastened to the lower end of said small bars and extending for the whole length of the relative work zone of the needles;

guide means for said segments suited to cause their contemporary swinging according to said opposite directions perpendicular to said plate, during their vertical sliding, to allow the mutual change of position of said stitch-pressing means;

a series of stitch-retaining means, placed and being operating at the beginning and at the end of each work zone.

2. A device according to claim 1, wherein said stitch-retaining means comprise:

a block having a parallelepipedal shape, made integral with an extension of said plate, extending downwards;

a framework, through which said block passes, and whose inner hole is such as to allow vertical translations according to said lowering and raising directions;

elastic means acting on said framework to keep it, with a predetermined pressure, pressed downwards;

a wedge-shaped element, integral with the base of said framework and turned with its tip downwards, designed to press on the knitted fabric just formed;

two small plates placed bilaterally as to said block, parallel to said plate.

3. A device according to claim 2, wherein said guide means for said segments consist of two vertical cam grooves located bilaterally as to each pair of small bars with corresponding pins sliding within said cam grooves, each of said pins being respectively associated with a relative segment, with each of said grooves being provided with a loop turned to the opposite side with respect to that of the remaining groove, so as to bring about the swinging of said segments respectively according to opposite directions lying on planes perpendicular to said plate, when said pins pass through the stretch comprising said loops.

4. A device according to claim 1, said stitch-pressing means consist of an equal number of small rods having a "L" shape and extending horizontally each towards said small bar relative to the remaining small rod, and for the whole length of said work zone.

5. A device according to claim 2, wherein the vertical edges of a small plate are shaped in such a way as to form said guide means in cooperation with complementary bulges provided on the vertical edges of a remaining small plate, equally fastened to the side of the extension opposite to said block.

6. A device according to claim 1, wherein said drive means comprise:

a rack rod movable over said plate according to opposite directions parallel to the development of said plate;

a pinion gear engaging with said rack dragged into rotation according to opposite directions by a shaft connected with a stepping motor associated a said box-type element;

an end piece for each rocking lever fastened to said rack and provided with a seat within which a free end of said third arm is inserted.

* * * * *